US005548263A

United States Patent [19]

Bulgatz et al.

[11] Patent Number: 5,548,263

[45] Date of Patent: Aug. 20, 1996

[54] ELECTROMAGNETICALLY ACTUATED VALVE

[75] Inventors: Dennis C. Bulgatz, Reseda; Fernando B. Morinigo, Los Angeles, both of Calif.; Christopher Sortore, Charlottesville, Va.; Keith O. Stuart, Cypress, Calif.

[73] Assignee: Aura Systems, Inc., El Segundo, Calif.

[21] Appl. No.: 84,737

[22] Filed: Jun. 28, 1993

Related U.S. Application Data

[63] Continuation-in-part of Ser. No. 957,194, Oct. 5, 1992, Pat. No. 5,222,714.

[51] Int. Cl.[6] ..... F09L 9/04

[52] U.S. Cl. ..... 335/274; 335/256; 335/223; 335/266; 335/273; 123/90.11; 251/129.02; 251/129.09; 251/129.1; 251/129.15; 251/129.18

[58] Field of Search ..... 335/256, 223, 335/258, 266, 269, 273, 274; 123/90.11; 251/129.09, 129.1, 129.02, 129.15, 129.16, 129.18, 129.19

[56] References Cited

U.S. PATENT DOCUMENTS

| | | | |
|---|---|---|---|
| 4,455,543 | 6/1984 | Pischinger et al. | 335/266 |
| 4,515,343 | 5/1985 | Pischinger | 251/48 |
| 4,715,331 | 12/1987 | Kreuter | 123/90.11 |
| 4,719,882 | 1/1988 | Kreuter | 123/90.11 |
| 4,777,915 | 10/1988 | Bonvallet | 123/90.11 |
| 5,117,213 | 5/1992 | Kreuter et al. | 335/219 |
| 5,131,624 | 7/1992 | Kreuter et al. | 251/129.18 |

*Primary Examiner*—Brian W. Brown
*Assistant Examiner*—Raymond M. Barrera
*Attorney, Agent, or Firm*—Anthony T. Cascio; Lisa A. Merkadeau

[57] ABSTRACT

An electromagnetically actuator is disclosed having an electromagnet, a core element, the core element having a normally biased initial spaced apart first position distal from the electromagnet when the electromagnet is off and a second stop position proximal from the electromagnet when the electromagnet is on, a first resilient member adapted to bias said core element in the normally biased first position, and a second resilient member adapted to bias the electromagnet away from the core. The first resilient member is more resilient than the second resilient member. Therefore, the core approaches the electromagnet when the electromagnet is on until the core reaches the fixed stop position, and the electromagnet subsequently approaches the core to the fixed stop position. The actuator may further include an adjustment member that engages the electromagnet so as to control the pressure of the electromagnet against the second resilient member, whereby the axial position of the electromagnet is controlled.

8 Claims, 2 Drawing Sheets

ELECTROMAGNETICALLY ACTUATED VALVE

RELATED APPLICATION DATA

The present application is a continuation-in-part of commonly owned, application U.S. Ser. No. 07/957,194, now U.S. Pat. No. 5,222,714, filed on Oct. 5, 1992 for Electromagnetically Actuated Valve, which is incorporated by reference herein.

FIELD OF THE INVENTION

The present invention relates generally to an electromagnetically actuated valve, and more particularly to an electromagnetically actuated valve that allows for precise control of valve seating pressure.

BACKGROUND OF THE INVENTION

In the past, valves have been designed for opening and closing mechanisms that combine the action of springs with electromagnets. For example, in U.S. Pat. No. 4,614,170 issued to Pischinger, it is disclosed to use springs in an electromagnetically actuated valve to switch from an open to closed position and vice versa. In these valves, the core lies at a center equilibrium position between two electromagnets To close the valve, a first electromagnet is energized, attracting the core to the first electromagnet and compressing a spring. To open the valve the energized first electromagnet is turned off and the second electromagnet is energized. Due to the force of the pre-stressed spring, the core is accelerated toward the second electromagnet, thereby reducing the amount of magnetic force required to attract the core away from the One problem with the earlier valve designs was that the valves did not operate quickly enough to open and close the valves with sufficient speed, force or stroke required for the opening and closing of an internal combustion engines intake and exhaust valves, or for the force and stroke required for gas compressors. Therefore, a need existed for a valve design that provided an efficiently designed moving core assembly that could be accelerated quickly enough for the desired applications, such as the modern internal combustion engines.

Another problem encountered with the design of electromagnetically actuated valves is in obtaining the precise mechanical tolerances required to achieve a zero gap at the upper electromagnet when the valve is properly seated. This problem is exacerbated by the thermal expansion that occurs during operation of the valve. Under test conditions, the valve stem of an electromagnetic actuator has lengthened up to 12 thousandths of an inch due to heat expansion. When the valve closes, the pole face contacts the upper electromagnet, but due to the increased length in the valve stem, the valve may not be seated properly. Alternatively, the valve may be seated before the core element reaches the upper electromagnet, preventing the valve from obtaining a zero gap. A zero gap is desired to maintain power consumption at a low level, and therefore, the valve is not operating at a desired efficiency level.

Another problem with the previously designed valves is that the moving core assembly must return to an initial neutral position when not in operation. The initial neutral position of the core element must be equidistant from both the first electromagnet and the second electromagnet. As previously described, it is known to use a spring to bias the core assembly in this neutral position. However, spring tensions inevitably vary, which creates difficulty in obtaining a neutral position for the core element that is centered between the electromagnets. Therefore, it is desirable to have an means for manually adjusting the position of the core element in order to achieve the centered neutral position.

SUMMARY OF THE INVENTION

Accordingly, it is a primary object of the present invention to overcome one or more disadvantages and limitations of the prior art.

A significant object of the present invention is to provide an electromagnetic valve that provides a more efficient core assembly design.

Another object of the present invention is to provide an electromagnetic actuator that compensates for heat expansion during operation of the actuator.

Another object of the present invention is to provide electromagnetic actuator with manual adjustment for obtaining precise mechanical tolerances.

According to a broad aspect of the present invention, an electromagnetically actuator comprises at least one electromagnet, at least one core element, the core element having a normally biased initial spaced apart first position distal from the electromagnet when the electromagnet is off and a second fixed stop position proximal from the electromagnet when the electromagnet is on, a first resilient member adapted to bias said core element in the normally biased first position, and a second resilient member adapted to bias the electromagnet away from the core. The first resilient member is more resilient than the second resilient member. Therefore, the core approaches the electromagnet when the electromagnet is on until the core reaches the second stop position, and the electromagnet subsequently approaches the core to the second stop position. The actuator may further include an adjustment member that engages the electromagnet so as to control the pressure of the electromagnet against the second resilient member, whereby the axial position of the electromagnet is controlled.

A feature of the present invention is that the combination of the first and second resilient members provides compensation for heat expansion of the moving assembly in the actuator.

Another feature of the present invention is that the adjustment device allows the neutral position of the core assembly to be set precisely.

Another feature of the present invention is that the design of the moving core assembly allows quick acceleration of the actuator.

These and other objects, advantages and features of the present invention will become readily apparent to those skilled in the art from a study of the following description of an exemplary preferred embodiment when read in conjunction with the attached drawing and appended claims.

DESCRIPTION OF AN EXEMPLARY PREFERRED EMBODIMENT

Figure 1:
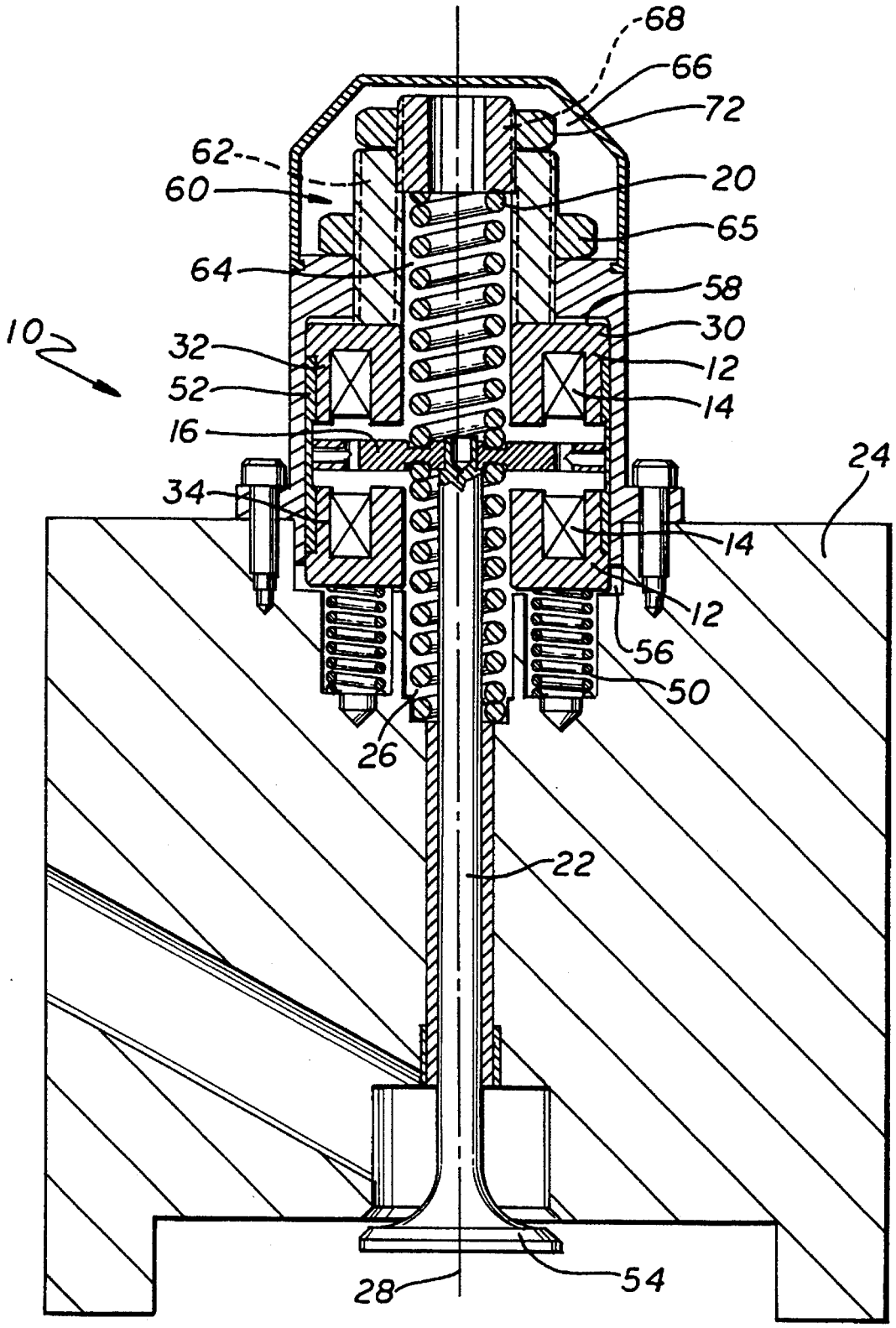
FIG. 1 is a cross-sectional view of one embodiment of electromagnetically actuated valve of the present invention providing precise control of valve seating pressure.

Referring now to FIG. 1, one embodiment of an electromagnetically actuated valve 10 of the present invention is shown in cross-section. In the embodiment shown, the valve 10 includes two pairs of electromagnetic elements 12, a plurality of coils 14, a core or armature element 16, a support spring 20, a valve stem 22, and a valve case 24. Each of the electromagnetic elements 12 are preferably annular-shaped, and define a central chamber 26. The central chamber 26 further defines a central vertical axis 28.

In the embodiment shown in FIG. 1, each pair of electromagnetic elements 12 further comprises an upper electromagnetic element 32 and a lower electromagnetic element 34. The upper and lower electromagnetic elements are in a mirrored relationship to each other, with the central channels 30 of the upper and lower electromagnetic elements being in a facing relationship to each other.

Disposed intermediate the upper and lower electromagnetic elements 32, 34 is the core element 16. The core element 16 is preferably annular-shaped in horizontal cross-section. The core element 16 provides two pole faces 42.

The core element 16 is interconnected to the valve stem 22. The valve stem 22 preferably extends in axial alignment with the central vertical axis 28 of the central chamber 26 of the electromagnetic elements 12. A valve case 24 encloses the valve.

The support spring 20 is also disposed within the central chamber 26, preferably surrounding the valve stem 22. In the embodiment shown, the lower end of the support spring contacts the valve case 24. The valve also includes two compliance springs 50. In the embodiment shown, the compliance springs contact a portion of the valve case 24 and the lower electromagnet 34. The lower and upper electromagnets 32, 34 are connected by a spacer 52. The spacer 52 maintains a constant distance between the upper and lower electromagnets 32, 34. Therefore the upper and lower electromagnets act as an assembly.

The compliance springs 50 are used to compensate for heat expansion in the valve stem. More specifically, when the valve head 54 is properly seated, the core element 16 should be in contact with the upper electromagnet 32. If the valve stem expands, the core element will contact the upper electromagnet 32 before the valve head 54 is properly seated. However, if the valve stem is shortened to accommodate for heat expansion, the valve head may seat before the core 16 contacts the upper electromagnet.

In order to solve this problem, the support spring is used to bias the core element in the normally biased first position. The support spring is a resilient member, and has a known value of resiliency. The compliance springs are then used to bias the upper electromagnet away from the core. The compliance springs are also resilient members, and also have a known value of resiliency. The support spring 20 and compliance springs 50 are selected such that the resiliency of the support spring 20 is greater than the resiliency of the compliance springs 50. Therefore, when the electromagnet is on, the core 16 moves upward toward the upper electromagnet 32 until the valve head is seated. At this point, the upper electromagnet is attracted downward to the core element 16, until a so zero gap exists between the core 16 and the upper electromagnet 32.

Still referring to FIG. 1, the valve includes a lower compliance space 56 between the lower electromagnet 34 and the valve case 24 and an upper compliance space 58 between the upper electromagnet 32 and the valve case 24. The compliance spaces 56, 58 allow for movement of the upper and lower electromagnet assembly in reaction to the compliance springs 50 without contacting the valve case 24.

It is to be understood that the compliance springs may be comprised of any resilient member, and may also engage with any portion of the upper and lower electromagnet assembly, while still providing the same heat expansion compensation feature described above.

Still referring to FIG. 1, another feature of the present invention is described in detail. This feature is an electromagnet adjustment member 60, and allows for the adjustment of the upper and lower electromagnet assembly in an axial direction without affecting the axial position of the core element, valve stem or valve case. Therefore, the precise mechanical tolerances required of the electromagnet positioning may be manually obtained after the valve is assembled. In the embodiment shown, the electromagnet adjustment member 60 includes a hollow threaded bolt 62 threadingly engaged with the valve case 24. The bolt 62 is hollow and defines a bolt cavity 64, which allows clearance for the support spring 20. In the embodiment shown, the bolt, when tightened, applies pressure on the upper electromagnet 32, thereby pushing the electromagnet assembly in a downward axial position, and compressing the compliance springs 50. Similarly, the bolt 62 may be loosened, allowing the compliance springs 50 to force upward axial movement of the electromagnet assembly. It should be noted that the bolt 62 may be designed to apply pressure on a different location of the electromagnet assembly, however, the interconnection of the upper and lower electromagnet by the spacer 52 allows the electromagnet adjustment member 60 to affect both the upper and lower electromagnets simultaneously. The electromagnet adjustment member 60 may further include a first nut 65 for securing the bolt 62 in the proper position.

Another feature of the present invention is the support spring adjustment member 66. The support spring adjustment member 66 is shown in FIG. 1 as comprising a hollow screw member 68. The hollow screw member 68 is threadingly engaged into the bolt cavity 64. In the embodiment shown, the hollow screw member 68 engages the upper end of the support spring 20. The support spring 20 engages the core element 16. Therefore, when the screw member 68 is tightened, the support spring compresses, moving the core element in a downward axial position. When the screw member 68 is loosened, the support spring expands, allowing the core element to move in an upward axial position. The support spring adjustment member 66 may also include a second nut 72 for securing the screw is 68 into position.

The function of the support spring adjustment member 66 is to provide precise positioning of the core element 16 between the upper and lower electromagnets 32, 34. As previously described, the core element should be precisely centered between the electromagnets. The support spring adjustment member 66 allows the manual positioning of the core element after the valve is assembled. It is to be noted that the support spring adjustment member 66 may contact the support spring in another area and still provide the same core positioning feature.

The operation of the valve 10 is described in detail in U.S. Pat. No. 5,222,714, filed on Oct. 5, 1992 and U.S. Pat. No. 5,355,108, filed on Dec. 9, 1992, both of which are assigned to the assignees herein and are incorporated by reference.

Figure 2:
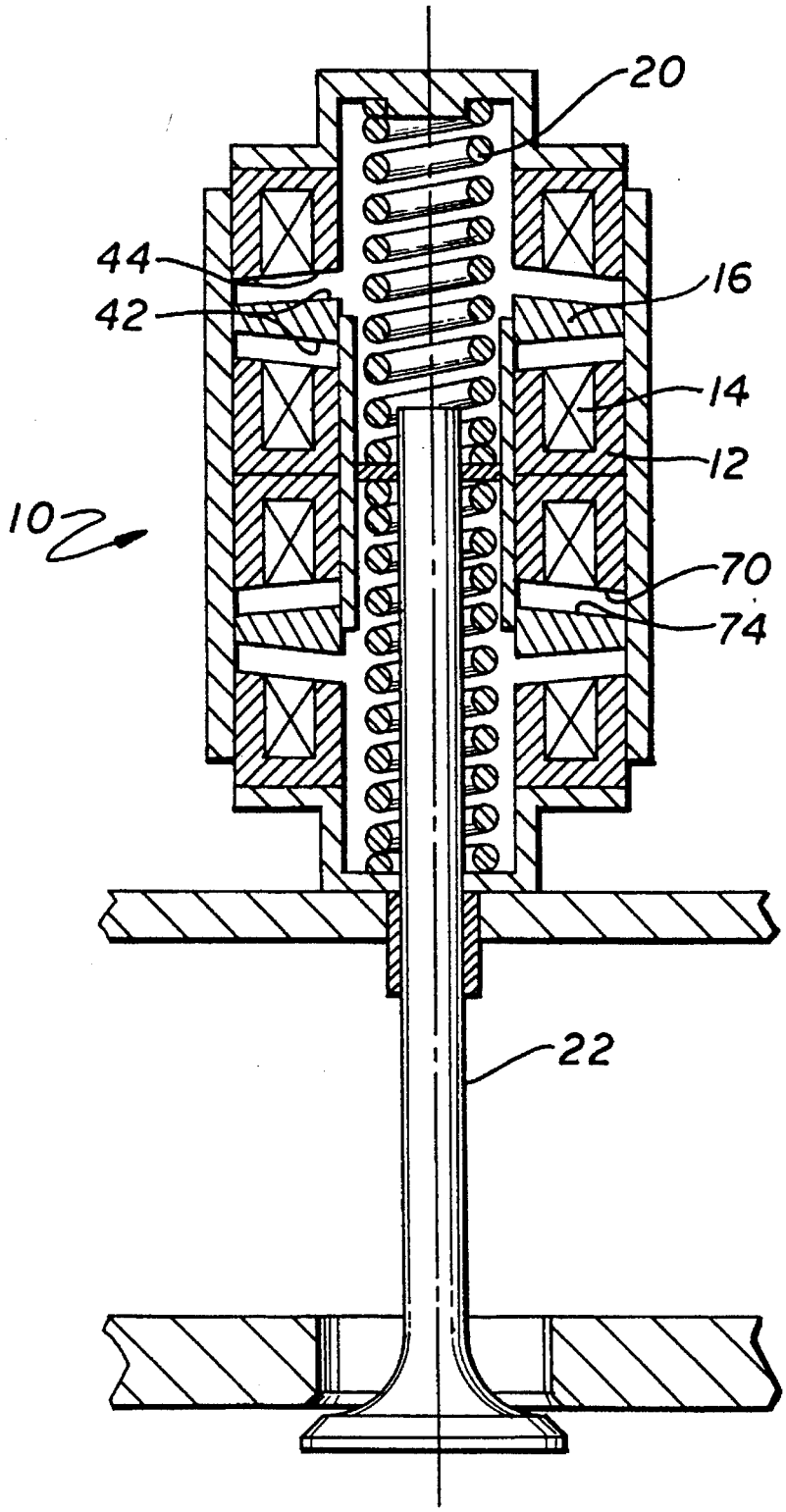
FIG. 2 is a cross-sectional view of another embodiment of the electromagnetically actuated valve of the present invention

Referring now to FIG. 2, a unique core and electromagnet design is shown in detail. As seen in FIG. 2, the electromagnetic elements 12 define a first surface 70. The first surface 70 defines the central chamber or opening 26, and the continuous channel 26 extending around the opening 26. The coil 14 is disposed in the continuous channel 26. The first surface 70 of the electromagnet is preferably substantially convex-shaped. The armature or core element 16 is in a normally biased initial spaced apart position from the electromagnetic elements 12. The core element 16 also defines a pole surface 72. The core pole surface 72 is substantially concave-shaped to correspond to the first surface 70 of the electromagnetic element.

The angle of the surfaces 70, 72 provides for increased contact between the electromagnetic elements and the core elements. The angle of the pole faces relative to the stroke motion of the valve serves to reduce the amount of current required to pull the valve from an open to closed position, and vice versa. Therefore, as described in U.S. Pat. No. 5,355,108, filed on Dec. 9, 1992, which is incorporated by reference herein, the design of the present invention solves the problems of providing sufficient pole face area, a sufficient flux return path, and a sufficiently large magnetic field to provide the desired force, while maintaining a sufficiently small moving mass to allow valve operation at desired speeds of revolution.

It is also to be noted that in another embodiment of the valve 10 of the present invention two pairs of electromagnetic elements may be utilized. The first pair of electromagnets then stacked on top of the second pair of electromagnets. The use of multiple electromagnetic element pairs and cores is significant in that it reduces the mass required to complete the magnetic circuit, without reducing the area allocated for the flux. Therefore, although the current and power requirements will increase with multiple electromagnet pairs and cores, the total current and power requirement remains desirably manageable.

There has been described hereinabove an exemplary preferred embodiment of the electromagnetically actuated valve according to the principles of the present invention. Those skilled in the art may now make numerous uses of, and departures from, the above-described embodiments without departing from the inventive concepts disclosed herein. Accordingly, the present invention is to be defined solely by the scope of the following claims.

I claim as my invention:

1. An electromagnetic actuator comprising:

at least one electromagnet;

at least one armature element, said armature element having a normally biased initial spaced apart first position distal from said electromagnet when said electromagnet is off and a fixed stop position proximal from said electromagnet when said electromagnet is on;

a first resilient member adapted to bias said armature element in said normally biased first position, said first resilient member having a first level of resiliency; and a second resilient member adapted to bias said electromagnet away from said armature, said second resilient member having a second resiliency level, wherein said first resiliency level is greater than the second resiliency level, whereby said armature approaches said electromagnet when said electromagnet is on until said armature reaches said fixed stop position, and said electromagnet subsequently approaches said armature to said fixed stop position.

2. An actuator in accordance with claim 1 further comprising:

an electromagnet adjustment member, said electromagnet adjustment member engaging said electromagnet so as to control the pressure of said electromagnet against said second resilient member, whereby the axial position of said electromagnet is controlled.

3. An actuator in accordance with claim 1 further comprising:

at least one pair of electromagnets, each pair of electromagnets further comprising an upper electromagnet and a lower electromagnet, wherein the upper and lower electromagnets of said pair are in a mirror relationship to each other with said armature element being disposed intermediate said upper and lower electromagnets;

a spacer connecting said upper and lower electromagnets of said pair, said spacer maintaining an predetermined distance between said upper and lower electromagnets; and an electromagnet adjustment member, said electromagnet adjustment member engaging one of said upper and lower electromagnets so as to control the pressure of said lower electromagnet against said second resilient member, whereby the axial position of said electromagnets is controlled.

4. An actuator in accordance with claim 1 further comprising:

a resilient member adjustment member, said adjustment member engaging said first resilient member so as to control the tension in said first resilient member, whereby the neutral position of said armature element is controlled.

5. A temperature compensating electromagnetic actuator for an actuated valve, the valve having a closed position and having a valve stem exhibiting thermal expansion comprising:

at least one electromagnet;

at least one armature element adapted to be mounted to the valve stem, said armature element having a normally biased initial spaced apart first position distal from said electromagnet when said electromagnet is off and an indeterminate second position proximal from said electromagnet when said electromagnet is on, said indeterminate second position varying in relation to the thermal expansion of the valve stem and corresponding to the valve closed position;

a first resilient member adapted to bias said armature element in said normally biased first position, said first resilient member having a first level of resiliency; and a second resilient member adapted to bias said electromagnet away from said armature, said second resilient member having a second resiliency level, wherein said first resiliency level is greater than the second resiliency level, whereby said armature approaches said electromagnet when said electromagnet is on until said armature reaches said second position, and said electromagnet subsequently approaches said armature to said second position.

6. A temperature compensating electromagnetically actuated valve in accordance with claim 5 further comprising:

an electromagnet adjustment member, said electromagnet adjustment member engaging said electromagnet so as to control the pressure of said electromagnet against said second resilient member, whereby the axial position of said electromagnet is controlled.

7. A temperature compensating electromagnetically actuated valve in accordance with claim 5 further comprising:

at least one pair of electromagnets, each pair of electromagnets further comprising an upper electromagnet and a lower electromagnet, wherein the upper and lower electromagnets of said pair are in a mirror relationship to each other with said armature element being disposed intermediate said upper and lower electromagnets;

a spacer connecting said upper and lower electromagnets of said pair, said spacer maintaining an predetermined distance between said upper and lower electromagnets; and an electromagnet adjustment member, said electromagnet adjustment member engaging one of said upper and lower electromagnets so as to control the pressure of said lower electromagnet against said second resilient member, whereby the axial position of said electromagnets is controlled.

8. A temperature compensating electromagnetically actuated valve in accordance with claim 5 further comprising:

a resilient member adjustment member, said adjustment member engaging said first resilient member so as to control the tension in said first resilient member, whereby the neutral position of said armature element is controlled.

* * * * *